US005255722A

United States Patent [19]

Furstenberg

[11] Patent Number: 5,255,722

[45] Date of Patent: Oct. 26, 1993

[54] VAPORLESS LIQUID CONTAINMENT SYSTEM

[75] Inventor: John L. Furstenberg, Brookfield, Wis.

[73] Assignee: Envirex Inc., Waukesha, Wis.

[21] Appl. No.: 849,755

[22] Filed: Mar. 12, 1992

[51] Int. Cl.[5] ..... B65B 3/16

[52] U.S. Cl. ..... 141/114; 141/98; 220/585; 220/530; 340/632; 62/47.1

[58] Field of Search ..... 141/51, 52, 67, 98, 141/104, 114; 220/585, 581, 530, 901; 137/264; 340/632; 62/45.1, 47.1, 9

[56] References Cited

U.S. PATENT DOCUMENTS

| | | | |
|---|---|---|---|
| 569,028 | 10/1896 | Nathan . | |
| 2,758,747 | 8/1956 | Stevens | 220/63 |
| 2,863,297 | 12/1958 | Johnston | 62/45 |
| 2,955,723 | 10/1960 | McGrath | 220/20.5 |
| 3,101,861 | 8/1963 | Mearns, III et al. | 220/10 |
| 3,135,420 | 6/1964 | Farrell et al. | 220/63 |
| 3,169,379 | 2/1965 | Black | 62/50 |
| 3,647,103 | 3/1972 | Berman | 220/3 |
| 3,919,855 | 11/1975 | Turner | 62/45 |
| 4,117,951 | 10/1978 | Winckler | 220/461 |
| 4,172,152 | 10/1979 | Carlisle | 426/127 |
| 4,308,973 | 1/1982 | Irland | 220/454 |
| 4,466,553 | 8/1984 | Zenger | 220/461 |
| 4,826,045 | 5/1989 | Price et al. | 222/95 |
| 4,836,409 | 6/1989 | Lane | 220/403 |
| 4,902,304 | 2/1990 | Hallen | 48/174 |
| 5,002,101 | 3/1991 | McLeod | 141/98 |

FOREIGN PATENT DOCUMENTS 58-13258 1/1983 Japan .

OTHER PUBLICATIONS

Sales bulletin of Envirex Ltd., Waukesha, Wisconsin, entitled "PFT Dystor Gas Holder" published in 1989.

Sales bulletin of Petrex, Inc., Warren, Pennsylvania, "PETREX Oil-Water Separator Cover System", published 1982.

Sales literature of Staff Industries, Inc., Detroit, Michigan, "Industries, Inc. The International Leader in Large-Scale Containment Liners and Floating Cover Systems", publication date unknown.

Sales literature of Revoc, Inc., Henniker, New Hampshire, "Containment Systems Municipal/Industrial/-Water/Waste", published 1982.

Sales brochure of Conservatek Industries, Inc., Conroe, Texas, "The Best Covers for Wastewater Treatment", publication data unknown.

Sales literature of Fiberglass Structures/Canbar Inc., Waterloo, Ontario, Canada, "Canbar Fiberglass Structures", publication date unknown.

Sales literature of Burke Ruber Company, San Jose, California, "Hypalon from Burke, For Jobs No Other Pond Liner or Cover Can Handle", published 1982.

Chemical Equipment, "Selecting Flame and Detonation Arresters", May, 1991, p. 16.

*Primary Examiner*—Henry J. Recla
*Assistant Examiner*—Steven O. Douglas
*Attorney, Agent, or Firm*—Michael, Best & Friedrich

[57] ABSTRACT

A vaporless liquid containment system for storing volatile and other liquids while preventing the formation and escape of vapors. The vessel includes a base and a first membrane, the first membrane defines a fluid containment space for containing stored liquid. A fluid-tight gas containment space is located above the first membrane. The gas containment space is adapted to house a gas under pressure. As liquid to be stored is supplied to and withdrawn from the fluid containment space, the gas housed in the gas containment space supplies fluid pressure to the first membrane so that the pressure on the first membrane is maintained above the vapor pressure of the stored liquid. This prevents the formation of vapor caused by the evaporation of the stored liquid.

22 Claims, 2 Drawing Sheets

VAPORLESS LIQUID CONTAINMENT SYSTEM

BACKGROUND OF THE INVENTION

1. Field of the Invention

The present invention relates to vaporless liquid storage devices, and more specifically, to volatile liquid storage devices which prevent the accumulation of vapor caused by the evaporation of the stored liquid.

2. Description of the Prior Art

The storage of liquids especially volatile liquid often presents problems because of the possible effect of vapor creation, accumulation and release. In the petroleum and chemical industries, liquids such as benzene, crude oil and alcohol need to be stored in a vessel where potentially volatile vapors are not created or accumulated in the vessel.

Liquid storage vessels for storing volatile and other liquids are well known in the art. One type of liquid storage system includes a hard shelled vessel for containing the stored liquid. U.S. Pat. No. 2,863,297 issued to Johnston is of this type. This patent illustrates an apparatus for storing volatile liquids at atmospheric pressure whereby the storage temperature of the liquid is controlled by a radiation shield. U.S. Pat. No. 2,955,723 issued to McGrath also illustrates a closed tank storage system. This system maintains a substantial pressure within the vessel and provides an upper gas storage portion to contain the vapors of the liquid.

Other liquid storage vessels are directed at maintaining the liquid at a desired temperature and/or pressure such as U.S. Pat. No. 3,919,855 issued to Turner. Other prior art devices for containing volatile liquids include vessels with fixed covers and vessels with slidable or floating covers which move upwardly and downwardly as liquid is supplied to or withdrawn from the vessel. These systems do not effectively contain or prevent creation of hazardous vapors from the stored liquid.

Various membrane systems have been developed for storing liquids. U.S. Pat. No. 4,308,973 issued to Irland illustrates a single membrane aerosol container system. Aerosol containers commonly have only one membrane or pouch and do not provide for supply as well as withdrawal of the contained liquid. Another membrane type storage device is depicted in U.S. Pat. No. 2,758,747 issued to Stevens. In that invention, a tank is fitted with one or two flexible bag-type members for the storage of one or two different liquids. The collapsing action of the bag-type member prevents vapor losses of the liquids yet it does not prevent vapor creation.

Another membrane system for storing liquids is illustrated in U.S. Pat. No. 4,836,409 issued to Lane. A hydropneumatic tank is fitted with a diaphragm-liner. One side of the diaphragm-liner contains a compressed gas while the other side contains a liquid. The pressurized gas forces the liquid into and out of the tank as needed. Various other single membrane systems have been used to store liquids in the prior art.

In the storage of gases, a duel membrane system forming r two chambers is disclosed in U.S. Pat. No. 4,902,304 issued to Hallen and assigned to the assignee of the present invention. The structure of Hallen includes an inner gas filled chamber connected to a source of gas. A predetermined level of pressure is maintained upon the inner gas storage chamber by an outer membrane which creates an outer air filled chamber. The volume of air within the outer air filled chamber compensates for changes in the volume of gas in the inner chamber to maintain a constant pressure thereon.

SUMMARY OF THE INVENTION

The present invention provides an apparatus for storing liquids which maintains a pressure o the liquid being stored sufficient to prevent the formation of vapors caused by the evaporation of the stored liquids as liquid is withdrawn from and added to the liquid storage device. More specifically, the invention includes a support structure having a supporting surface and a first membrane supported by the support structure. The first membrane defines a fluid containment space for storing liquid therein. The invention includes means for forming a fluid-tight gas containment space above the first membrane. The gas containment space is adapted to house gas under pressure to maintain fluid pressure on the first membrane. The invention also includes means for supplying fluid pressure to the gas containment space sufficient to maintain the liquid in the fluid containment space in a liquid state and to prevent the formation of vapor in the fluid containment space.

It is a feature of the present invention to provide a liquid containment system which stores liquids while preventing the buildup of vapors of the liquid which would result in liquid loss from evaporation and a potentially dangerous situation.

It is also a feature of the present invention to prevent the release of hazardous vapors to the atmosphere and maintain compliance with all applicable environmental regulations.

BRIEF DESCRIPTION OF THE DRAWINGS

The features of the present invention which are believed to be novel are set forth with particularity in the claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
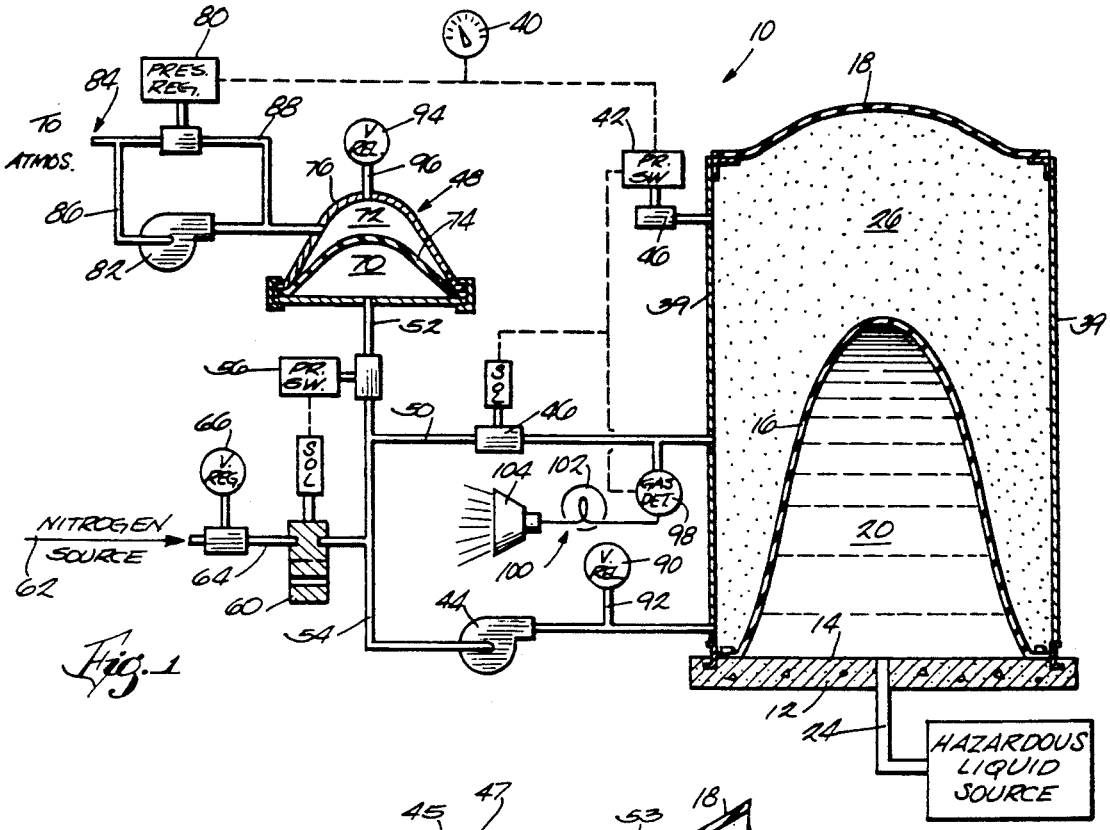
FIG. 1 is a schematic view of a fluid containment apparatus embodying the invention.
Figure 2:
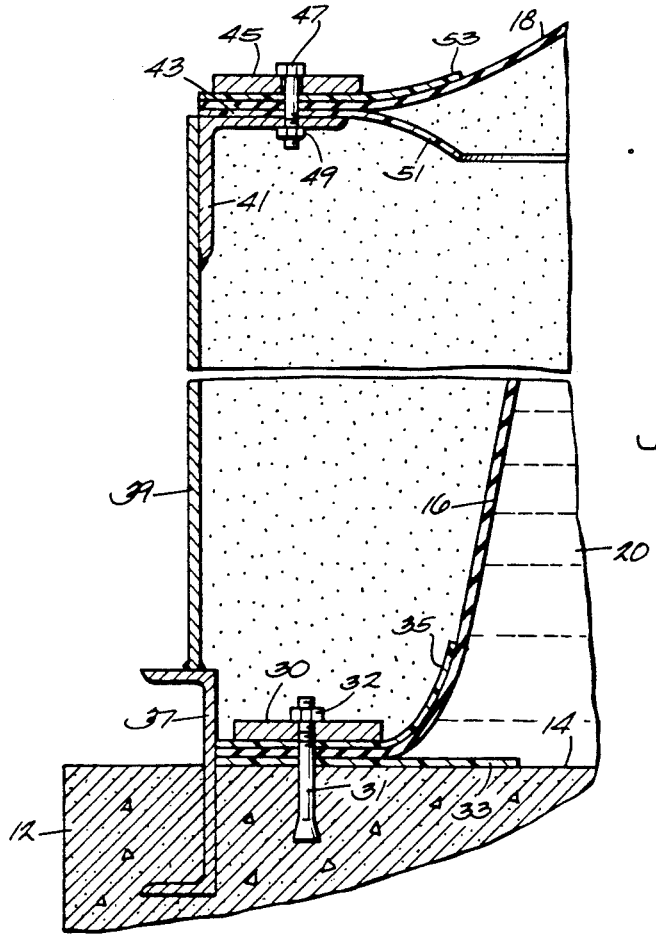
FIG. 2 is an enlarged partial view of the apparatus shown in FIG. 1.

Referring to the drawings, a vaporless liquid containment system 10 is illustrated in FIG. 1. The system includes a base or support structure 12 having an upper supporting surface 14, container walls 39 and first and second membranes 16 and 18 respectively. In an alternate embodiment of the invention, the second membrane can be replaced by a fixed sealed cover. The first membrane 16 in conjunction with the base 12 form a fluid containment space 20. Liquid to be stored is contained in the fluid containment space 20 and is supplied to or withdrawn from that space via line 24. First membrane 16 in conjunction with second membrane 18, which is positioned over first membrane 16, form a gas containment space 26. The gas containment space 26 houses a gas under pressure and is used to supply pressure to the first membrane 16 and the stored liquid in the fluid containment space 20. In the specific embodiment of the invention shown in FIG. 2, the periphery of the first membrane 16 is clamped or sealed to the periphery of the supporting surface 14 of the base 12 by hold down bars 30. More specifically, the periphery of the base includes a plurality of upwardly projecting anchor bolts 31 and hold down bars 30 secured by nuts 32 are used to firmly clamp the periphery of the membrane to the upper surface of the base. Flexible membrane supporting layers 33 and 35 are also provided to protect the peripheral portion of the membrane held by the clamping bars 30.

While the first membrane could be made of other materials, in a preferred form of this invention, the membrane is comprised of urethane fabric.

Means are also provided for supporting the second membrane 18 such that a fluid-tight gas containment chamber 26 is formed between the first membrane 16 and the second membrane 18. While the second membrane 18 could be supported in other ways, in the illustrated arrangement, a rail 37 is embedded in the periphery of the base 12 and a container wall 39 is welded to the rail 37 and projects upwardly from the rail 37 to form a generally cylindrical container or tank In one form of the invention, the container so formed is a steel tank. The upper edge of the container includes an angle or bracket 41 fixed to its inner surface, the bracket having an upper surface 43 surrounding the upper edge of the container. Hold down bars or clamps 45 are used to clamp the periphery of the second membrane 18 to the bracket 41 in fluid-tight relation. The hold down bars 45 are secured to the bracket by bolts 47 and nuts 49. Flexible membrane support layers 51 and 53 are also provided to protect the peripheral portion of the second membrane 18 clamped to the brackets 41.

While the second membrane could be made of other materials, in a preferred form of the invention, the membrane is comprised of polyester fabric.

In the operation of this invention, stored liquid is enveloped by the first membrane 16 such that the first membrane conforms to the stored liquid's profile at all times including when liquid is supplied to or withdrawn from the fluid containment space 16 via line 24. The pressure upon the first membrane 16 is maintained at a predetermined or set system pressure that is above the vapor pressure of stored liquid. The maintenance of this set system pressure prevents the accumulation of hazardous vapor caused by the evaporation of stored liquid and further prevents the loss of any of the liquid. The formation of vapors can lead to a potentially dangerous situation. In addition, the release of vapors to the atmosphere may have environmental consequences. The use of this invention prevents the formation and release of such vapors thus maintaining in compliance with any applicable environmental regulations.

The set system pressure maintained upon first membrane 16 and thus stored liquid in the preferred embodiment is produced by filling gas containment space 26 with a pressurized gas such as nitrogen. The pressure of the nitrogen in gas containment space 26 is monitored by a pressure gauge 40 and a pressure switch 42. As stored liquid is withdrawn from the fluid containment space 20, the pressure of the nitrogen in the gas containment space 26 decreases. This decrease is sensed by pressure gauge 40 and pressure switch 42. As the nitrogen pressure decreases so does the pressure upon the first membrane 16 and upon the stored liquid thus increasing the possibility of vapor formation. In the event the pressure on first membrane 16 and stored liquid falls below the predetermined system pressure, the pressure of the nitrogen in gas containment space 26 is increased by adding more nitrogen to that space. More specifically, when pressure switch 42 senses the pressure of the nitrogen in the gas containment space 26 below the set system pressure, the pressure switch 42 energizes blower 44 to add nitrogen to the gas containment space 26 until the pressure of the nitrogen in that space is restored to the set system pressure.

As liquid is added to fluid containment space 20 to be stored, the pressure of the nitrogen in the gas containment space 26 increases. Again, this increase is sensed by pressure gauge 40 and pressure switch 42. To restore the pressure of the nitrogen in gas containment space 26 to the set system pressure, pressure switch 42 energizes purge valve 46 to open thus removing nitrogen from that space until the nitrogen pressure equals the set system pressure.

The pressurized nitrogen in this embodiment is maintained in a closed loop to prevent losses. When nitrogen needs to be removed from the gas containment space 26, it is sent from that space to a separate storage vessel, pneumatic accumulator 48, via line 50 and line 52. When nitrogen needs to be added to the gas containment space 26, it is supplied by blower 44 to that space from pneumatic accumulator 48 via line 52 and line 54. If pressure switch 42 calls for nitrogen to be added to the gas containment space 26 and the stored nitrogen pressure switch 56 indicates low pressure, i.e., not enough nitrogen is contained in pneumatic accumulator 48 to supply what is needed in the gas containment space 26, the stored nitrogen pressure switch 56 will open solenoid valve 60 and allow regulated nitrogen from nitrogen source 62 to be added to line 64 to be sent to the gas containment space 26 via line 54 to make up for the deficiency. The nitrogen in nitrogen source 62 is regulated before entry into line 54 by regulator 66 on line 64.

The composition and operation of the pneumatic accumulator 48 are as follows. Pneumatic accumulator 48 is comprised of pressure vessel 68 having two chambers 70 and 72. First chamber 70 is formed from first chamber membrane 74 and contains the gas, nitrogen in this embodiment, which will be added to or was removed from the gas containment space 26. The pressure of the stored nitrogen in first chamber 70 is monitored by stored nitrogen pressure switch 56. The second chamber 72 is formed by second chamber membrane 76 in conjunction with first chamber membrane 74. Second chamber 72 contains air under pressure.

The nitrogen in first chamber 70 is stored at a pressure above the pressure of the nitrogen in the gas containment space 26. The pressure of stored nitrogen in first chamber 70 is maintained by the pressurized air in second chamber 72. The pressure of the air in second chamber 72 is controlled by air pressure regulator 80. Air pressure regulator 80 is maintained at a preselected air pressure that is below the selected system pressure of the nitrogen in the gas containment space 26. If air pressure regulator 80 senses that air pressure in the second chamber 72 is below the selected air pressure, air pressure regulator 80 instructs air blower 82 to add atmospheric air from air inlet/outlet 84 to second chamber 72 via line 86. If air pressure regulator 80 senses air pressure in second chamber 72 that is above the set air pressure, air pressure regulator 80 removes air from second chamber 72 to the atmosphere via line 88 and air intake/outlet 84.

In the illustrated embodiment of the vaporless liquid containment system 10, means are also provided for discharging nitrogen from the gas containment space 26 if the purge valve 46 or the pressure switch 42 fails and excess pressure is built up in the gas containment space 26. The means for discharging nitrogen includes a relief valve 90 which opens and discharges nitrogen directly to the atmosphere via line 92 to restore the selected system pressure in the event the pressure in the gas containment space exceeds a selected maximum pressure.

The illustrated embodiment of the invention also includes means for venting air from the second chamber 72 of the accumulator in the event that the pressure in the second chamber exceeds a maximum selected pressure. More specifically, if air pressure regulator 80 fails and excess pressure is built up in second chamber 72 of pneumatic accumulator 48, pressure relief valve 94 will open and vent air from second chamber 72 to the atmosphere via line 96 to restore the set air pressure in second chamber 72.

The apparatus embodying the invention also includes a gas detector 98 for monitoring the nitrogen exiting the gas containment space 26. In the event that the fluid containment space 20 is breached, i.e., the first membrane 16 fails and hazardous gas is present along with the exiting nitrogen, the gas detector 98 will sense the hazardous gas and an alarm 100 will be triggered. In the illustrated embodiment, alarm 100 includes a visual alarm 102 such as a flashing light and an audio alarm 104 such as a horn. The gas detector 98 ensures that no hazardous substances are released to the atmosphere, thus maintaining compliance with any applicable environmental regulations.

Figure 3:
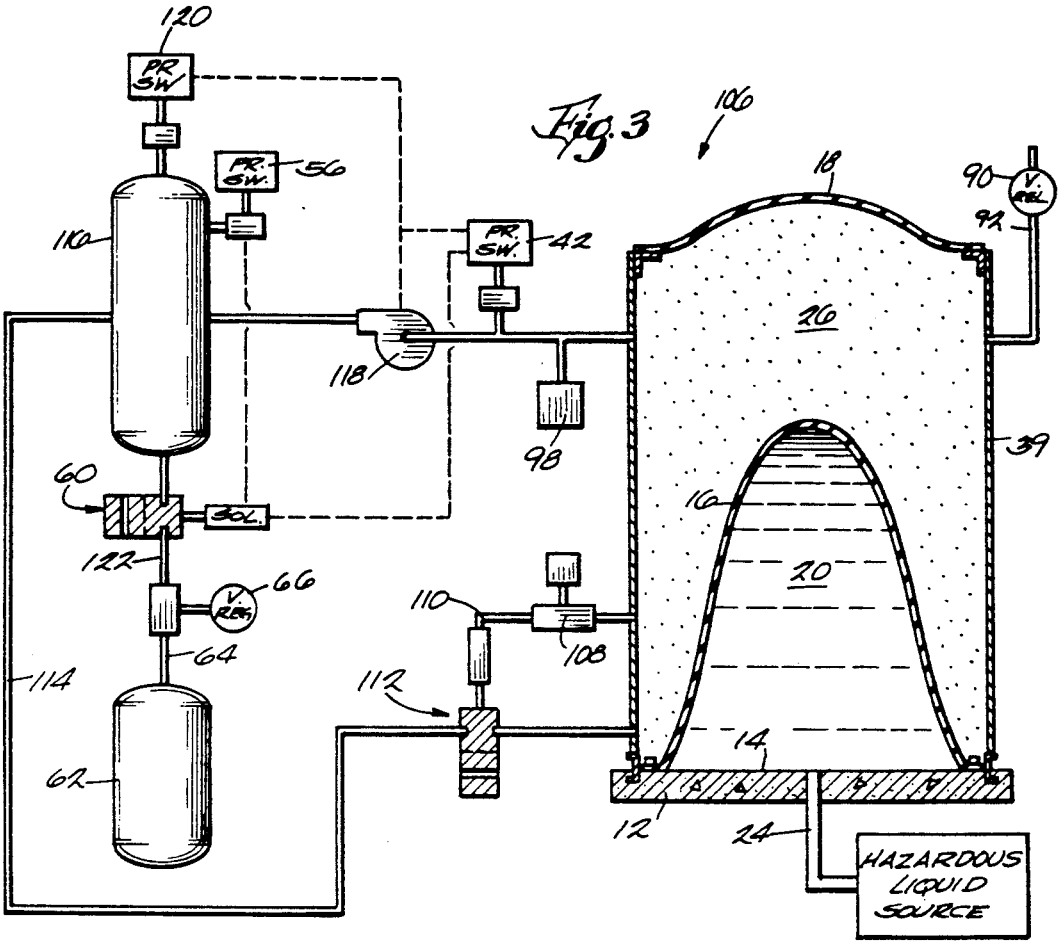
FIG. 3 is a schematic view of an alternate embodiment of the invention.

FIG. 3 shows an alternative embodiment of the invention in which like reference numerals denote like elements. The vaporless liquid containment system 106 operates in the following manner. As stored liquid is withdrawn from the fluid containment space 20, the pressure of the nitrogen in the gas containment space 26 decreases. This decrease in nitrogen pressure is sensed by the pilot regulator 108 located on line 110. As the nitrogen pressure in the gas containment space 26 decreases, so does the pressure upon the first membrane 16 and upon the stored liquid, increasing the possibility of vapor formation. The pressure on the first membrane 16 is restored to the set system pressure by adding more nitrogen to the gas containment space 26 which thus increases the pressure of the nitrogen in that space. Specifically, when the pilot regulator 108 senses the nitrogen pressure in the gas containment space 26 below the set system pressure, the pilot regulator 108 opens the main control valve 112 on line 114 to allow the high pressure nitrogen stored in the receiver 116 to be added to the gas containment space 26 via line 114 until the nitrogen pressure in that space is restored to the set system pressure.

As liquid is added to the fluid containment space 20 to be stored, the nitrogen pressure in the gas containment space 26 increases. This increase in pressure is sensed by pressure switch 42. To restore the nitrogen pressure in the gas containment space 26 to the set system pressure, pressure switch 42 energizes compressor 118 which compresses the excess nitrogen from the gas containment space 26 into the receiver 116 until the pressure within the receiver 116, as sensed by the receiver pressure switch 120, reaches a preset receiver pressure level. When this preset receiver pressure level is reached, receiver pressure switch 120 de-energizes compressor 118.

If the nitrogen pressure in the gas containment space reaches its set system pressure, as sensed by pressure switch 42, before the preset receiver pressure level is reached, the pressure switch 42 will de-energize the compressor 118 and nitrogen will stop being withdrawn from the gas containment space 26. If this occurs, i.e., the compressor 118 being shut off by the pressure switch 42 before the preset receiver pressure level is reached, solenoid valve 60 is energized by pressure switch 56 allowing nitrogen from the nitrogen pressure source 62 to be pressure regulated by regulator 66 then added to the receiver 116 via line 122 until the preset receiver pressure level, as sensed by the pressure switch 120, is reached.

This alternate embodiment also includes means for discharging nitrogen from the gas containment space 26 if pressure switch 42 fails and excess pressure, i.e., a selected pressure above the set system pressure, is built up in the gas containment space 26. This means for discharging nitrogen includes a relief valve 90 which will open and discharge nitrogen directly to the atmosphere via line 92 thus restoring the set system pressure in the gas containment space 26. This embodiment further includes a gas detector 98 for monitoring the nitrogen exiting the gas containment space 26. In the event that the fluid containment space 20 is reached, i.e., the first membrane 16 fails and hazardous gas is present along with the exiting nitrogen, gas detector 98 will sense this condition.

Figure 4:
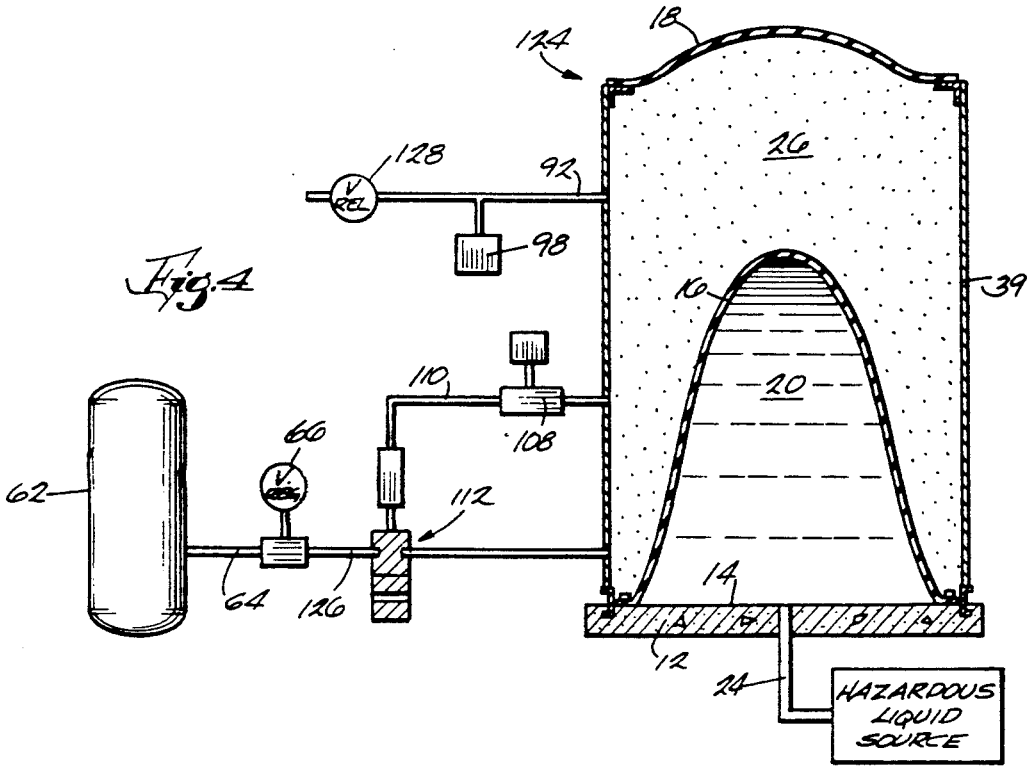
FIG. 4 is a schematic view of another alternative embodiment of the invention.

FIG. 4 shows another alternate embodiment of the invention in which like reference numerals denote like elements. The vaporless liquid containment system 124 operates in the following manner. The nitrogen source 62 is the sole means of nitrogen storage apart from the gas containment space 26. As liquid is withdrawn from the first fluid containment space 20 via line 24, the decrease in the nitrogen pressure in the gas containment space 26 is sensed by the pilot regulator 108. The pilot regulator 108 then energizes the main control valve 112 to allow the high pressure nitrogen stored in nitrogen source 62 to be added to the gas containment space 26 via line 126 until the pilot regulator 108 senses that the set system pressure is reached. As liquid is added to the fluid containment space 20 to be stored, the relief valve 128 opens and the excess nitrogen is released to the atmosphere to reduce the pressure in the gas containment space 26 until the set system pressure is reached.

This embodiment further includes a gas detector 98 for monitoring the nitrogen exiting the gas containment space 26. In the event that the fluid containment space 20 is reached, i.e., the first membrane 16 fails and hazardous gas is present along with the exiting nitrogen, gas detector 98 will sense this condition.

While particular embodiments of the invention have been shown and described, it will be obvious to those skilled in the art that changes and modifications may be made therein without departing from the invention in its broader aspects. Therefore, the intent in the claims is to cover all such changes and modifications as fall within the true spirit and scope of the invention.

What is claimed is:

1. An apparatus for forming a container for storing liquid and for preventing the formation of vapor in the container storing that liquid, the apparatus comprising:

a support structure having a supporting surface and a metallic wall structure surrounding and extending upward from the supporting surface, a first membrane supported by the support structure, the first membrane and the sufforting surface defining therebetween a fluid containment space for storing liquid, means for forming a fluid-tight gas containment space above the first membrane and between said wall structure, the gas containment space being adapted to house gas under pressure, means for supplying the gas under pressure to the gas containment space, the means for supplying the gas under pressure supplying a fluid pressure on the first membrane sufficient to maintain the liquid in the fluid containment space in a liquid state and to prevent the formation of vapor in the fluid containment space.

2. An apparatus a set forth in claim 1 wherein the means for forming a fluid-tight gas containment space includes a second membrane positioned over the first membrane so as to define the gas containment space between the first membrane and the second membrane.

3. An apparatus as set forth in claim 2 wherein the second membrane is fabricated of polyester fabric.

4. An apparatus as set forth in claim 2 and further including means for fixing the periphery of the second membrane to the supporting surface and to the periphery of the first membrane, said means for fixing the periphery of the second membrane including hold down bars.

5. An apparatus as set forth in claim 1 and further including means for supplying liquid to and withdrawing liquid from the fluid containment space.

6. An apparatus as set forth in claim 1 and further including means for sensing the pressure in the gas containment space.

7. An apparatus as set forth in claim 6 wherein the means for sensing the pressure in the gas containment space includes a pressure switch.

8. An apparatus as set forth in claim 1 wherein the first membrane is fabricated of urethane fabric

9. An apparatus as set forth in claim 1 and further including means for fixing the periphery of the first membrane to the supporting surface, said means for fixing including hold down bars.

10. An apparatus as set forth in claim 1 and further including means for discharging the gas under pressure in the gas containment space to the atmosphere if the pressure of the gas in the gas containment space exceeds a maximum selected pressure.

11. An apparatus as set forth in claim 1 and further including means for monitoring the pressurized gas exiting from the gas containment space, the means for monitoring including means for triggering an alarm in the event that a foreign substance is detected in the pressurized gas exiting from the gas containment space.

12. An apparatus as set forth in claim 1 wherein the gas under pressure is nitrogen.

13. An apparatus as set forth in claim 1 wherein the means for supplying a gas under pressure to the gas containment space includes:

a source of gas, means connected to the source of gas for adding the gas to the gas containment space, means for withdrawing gas under pressure from the gas containment space, and means for maintaining the gas under pressure in the gas containment space at a pressure above the vapor pressure of the liquid housed in the fluid containment space.

14. An apparatus for forming a container for storing liquid and for preventing the formation of vapor in the container storing that liquid, the apparatus comprising: a support structure having a supporting surface, a first membrane supported by the support structure, the first membrane and the supporting surface defining therebetween a fluid containment space for storing liquid, means for forming a fluid-tight gas containment space above the first membrane, the gas containment space being adapted to house gas under pressure, means for supplying the gas under pressure to the gas containment space, the means for supplying the gas under pressure supplying a fluid pressure on the first membrane sufficient to maintain the liquid in the fluid containment space in a liquid state and to prevent the formation of vapor in the fluid containment space; the means for supplying the gas under pressure to the gas containment space includes:

a source of gas, a source of air, means for sensing the pressure of the gas in the gas containment space, a pneumatic accumulator including a pressure vessel having a first chamber connected to the source of gas and for containing the gas under pressure, a second chamber for containing air under pressure and a flexible member for separating the first chamber of the pressure vessel from the second chamber of the pressure vessel, means for connecting the first chamber of the pressure vessel with the gas containment space, means for withdrawing gas under pressure from the gas containment space and sending it to the first chamber of the pressure vessel, means for adding gas to the gas containment space from the first chamber of the pressure vessel, means for adding gas under pressure from an independent source to the first chamber of the pressure vessel, means for sensing the pressure of the air in the second chamber of the pressure vessel, and means for adding or withdrawing air under pressure from the second chamber of the pressure vessel so as to maintain the pressure of the air in the second chamber of the pressure vessel below the pressure of the gas in the gas containment space.

15. An apparatus as set forth in claim 14 wherein the means for withdrawing gas under pressure from the gas containment space to the first chamber of the pressure vessel includes a purge valve.

16. An apparatus as set forth in claim 14 wherein the means for adding gas under pressure to the gas containment space from the first chamber of the pressure vessel includes a gas blower.

17. An apparatus as set forth in claim 14 wherein the means for withdrawing gas under pressure from the gas containment space and the means for adding gas under pressure to the gas containment space are controlled by a gas pressure switch.

18. An apparatus as set forth in claim 14 wherein the means for sensing the pressure of the air in the first chamber of the pressure vessel and the means for adding or withdrawing air to the second chamber of the pressure vessel includes a pressure regulator.

19. An apparatus as set forth in claim 14 wherein the means for connecting the first chamber of the pressure vessel to the gas containment space includes a gas line.

20. An apparatus as set forth in claim 14 and further including means for discharging the air under pressure in the chamber of the pressure vessel to the atmosphere if pressure of the air exceeds a maximum selected pressure.

21. An apparatus as set forth in claim 20 wherein the means for discharging the air under pressure in the second chamber of the pressure vessel to the atmosphere is a valve.

22. An apparatus as set forth in claim 14 wherein the flexible means for separating the first chamber of the pressure vessel from the second chamber of the pressure vessel is a membrane.

* * * * *